United States Patent [19]

Grinsted et al.

[11] Patent Number: 4,664,553

[45] Date of Patent: May 12, 1987

[54] PLOUGH ASSEMBLY

[75] Inventors: Timothy W. Grinsted, Ovingham; Alan R. Reece, Wylam, both of England

[73] Assignee: The British Petroleum Company p.l.c., London, England

[21] Appl. No.: 570,516

[22] Filed: Jan. 13, 1984

[30] Foreign Application Priority Data

Jan. 20, 1983 [GB] United Kingdom ..... 8301514

[51] Int. Cl.[4] ..... E02F 5/10; F16L 1/04

[52] U.S. Cl. ..... 405/180; 405/164

[58] Field of Search ..... 405/159, 161, 164, 174, 405/180, 183; 37/193

[56] References Cited

U.S. PATENT DOCUMENTS 2,875,585 3/1959 Little ..... 405/161

3,423,946 1/1969 Maclay .

4,428,132 1/1984 Reece ..... 405/161 X

FOREIGN PATENT DOCUMENTS 844269 8/1960 United Kingdom .

*Primary Examiner*—David H. Corbin

*Attorney, Agent, or Firm*—Morgan & Finnegan

[57] ABSTRACT

A self-loading plough assembly comprises a plough (2) having a channel (16) for the passage of a cable or pipe (8) and a cutter or cutters (5) for cutting and lifting a wedge of material from a substrate to form a trench into which the cable or pipe (8) is laid. The assembly also comprises a jib (11) for supporting the plough (2) and a carrier (7) for supporting the jib (11). The plough (2) is rotatably mounted under the jib (11) and the jib (11) is slideably mounted on the carrier (7) in such manner that the jib (11) can be raised or lowered and the plough (2) can be rotated about a horizontal axis to scoop the cable or pipe (8) into the channel (16).

The assembly can pick up cable or pipe from the ground, e.g., the sea bed, and load it into the plough without manual intervention for burial, and reverse the procedure if need be.

10 Claims, 8 Drawing Figures

PLOUGH ASSEMBLY

Figure 1:
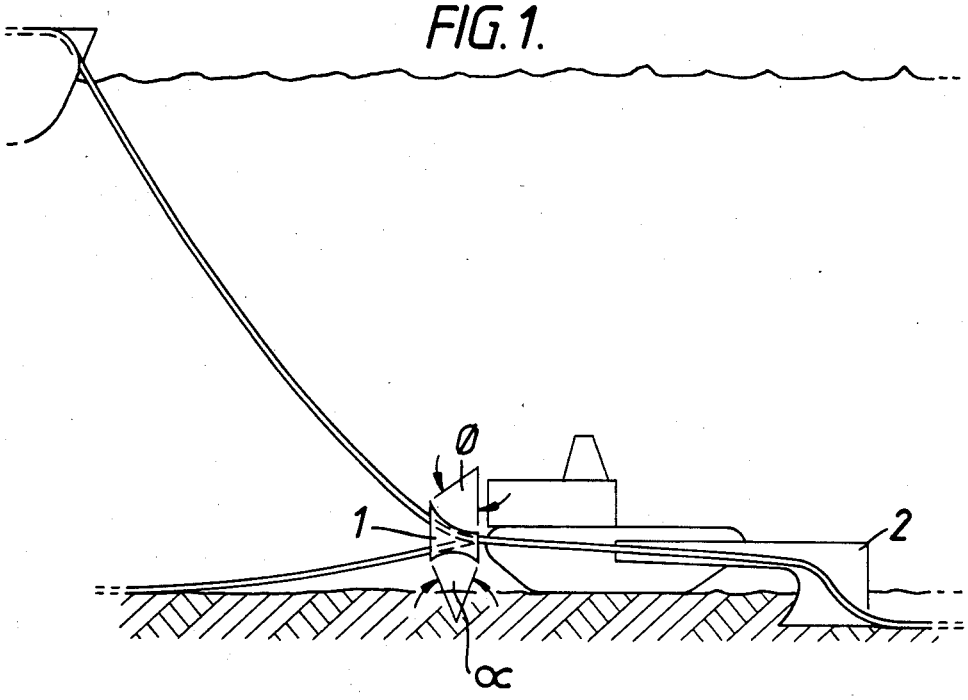

The present invention relates to a pipe or cable burying plough assembly, more particularly to an assembly suitable for use underwater.

Ploughs which have been previously proposed for burying pipes or cables usually comprise of a share which forces soil upwards and outwards to form a trench, followed by two parallel faces which hold the soil apart while the cable or pipe is lowered into the bottom of the trench between them. Even though the sides of the share may define a narrow steep sided trench, nevertheless the soil is disturbed and weakened in triangular zones extending upwards on either side of the share. The soil displaced is not returned to the trench in any controlled way with the result that the trench is not completely refilled and the burial depth of the pipe or cable is less than the depth cut by the plough share. The result is that the pipe or cable lies in the bottom of a relatively shallow wide trench filled with loosened and weakened soil, and inadequate protection is obtained.

Conventional equipment moves a considerable volume of soil in a way which involves a great deal of internal shearing and consequently requires a high force to pull the plough.

Our copending European patent application No. 0088190 discloses and claims a plough for burying cable or pipe which plough comprises at least two cutters laterally spaced apart, one being set at an angle relative to the other(s), for making two spaced apart cuts in a substrate to form a wedge of material, means for lifting and moving the wedge upwards and sideways to form a trench and means for guiding the cable or pipe into the trench under the lifted wedge.

After the cable or pipe has been laid and the plough has passed on, the wedge falls back into the trench without assistance and buries the cable or pipe.

This plough cuts an improved furrow shape, lifts the furrow slice a smaller distance in order to permit the cable or pipe to be inserted below it and allows the material to be replaced with minimum disturbance.

However, no means is provided for loading the cable or pipe into the plough.

It is an object of the present invention to provide a self-loading cable or pipe burying plough assembly which can pick up cable or pipe from the ground, usually the sea bed, and load it into the plough without manual intervention for burial, and reverse the procedure if need be.

Thus according to the present invention there is provided a self-loading plough assembly comprising (1) a plough having a channel for the passage of cable or pipe therethrough and a cutter or cutters for cutting and lifting a wedge of material from a substrate to form a trench into which the cable or pipe is laid, (2) a jib for supporting the plough, and (3) a carrier for supporting the jib, the plough being rotatably mounted under the jib and the jib being slidably mounted on the carrier whereby the jib can be raised or lowered and the plough can be rotated about a horizontal axis to scoop the cable or pipe into the channel.

A suitable plough is described in our copending European patent application No. 0088190.

Preferably the jib is pivoted for movement about a vertical axis and also about a horizontal axis, most preferably by means of a universal joint.

The movements are conveniently controlled by hydraulically actuated cylinders.

Preferably the plough is set at an angle relative to the jib to enable the plough to run to one side of the jib so that the channel is clear of all mountings and pivots.

When the plough assembly is used for burying a cable it will usually be desirable to employ a pivoted curved plate, called a dipper, attached to the jib to urge the cable into a curved section of the channel so that the cable emerges from the base of the channel.

In use, the assembly will be mounted on a carriage, preferably a tractor, most preferably a remote controlled tractor adapted for underwater operations.

The carriage is preferably fitted with an entry system to prevent the cable or pipe from bending too sharply and incurring damage as it passes through the carriage en route to the channel in the plough.

The entry system comprises a bell-mouth having a flared upper section and an opening lower section. Preferably the lower section comprises two pivoted arms. The sections of the arms forming part of the bell-mouth should also be curved.

The upper section is curved to accomodate cable or pipe being laid directly from a ship or barge and entering the carriage from above.

The lower section is curved to accomodate an alternative mode of operation in which the cable or pipe is pre-laid and enters the carriage from below.

The assembly may additionally contain a release mechanism suitable for use in an emergency which disconnects the plough from the rest of the assembly.

The plough is preferably attached to the jib by three withdrawable pins, and the release mechanism conveniently operates on one of the pins.

The release mechanism suitably comprises a locating pin attached to the plough, a cam attached to the jib and a plate attached to the plough, the cam being positioned between the pin and the plate.

In the normal position, the cam bears against the pin or a support therefor and locks it in a corresponding aperture on the jib. To release the pin, the cam is operated to move the plate, and hence the plough, sufficiently far back to disengage the pin.

The cam may be operated by an accumulator powered hydraulic ram, suitably actuated by a sonar pulse.

The total assembly is capable of receiving a cable or pipe from a ship, or picking up a cable or pipe from the sea bed and burying it along a closely defined line on the sea bed without requiring great steering accuracy from the ship and without the intervention of divers to load and unload the cable or pipe.

The release mechanism enables the assembly to cope with a major breakdown of any part of the system which traps the carriage on the sea bed with the cable or pipe running over it. When the plough is pushed backwards relative to the jib and disengaged, the carriage, complete with jib and dipper, can then be lifted clear to the surface leaving the plough in the sea bed beneath the cable or pipe. The latter can then be lifted off the plough and the plough raised to the surface.

Figure 2:
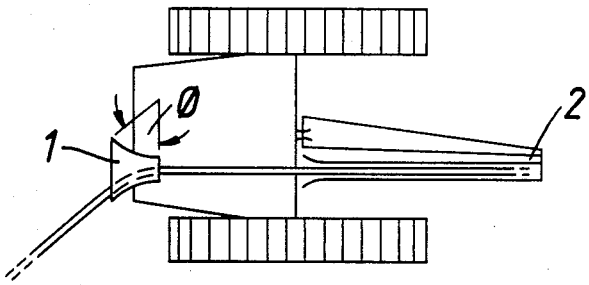
Figure 3:
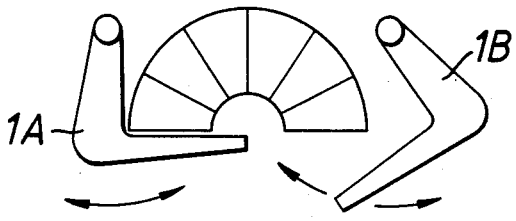
Figure 4:
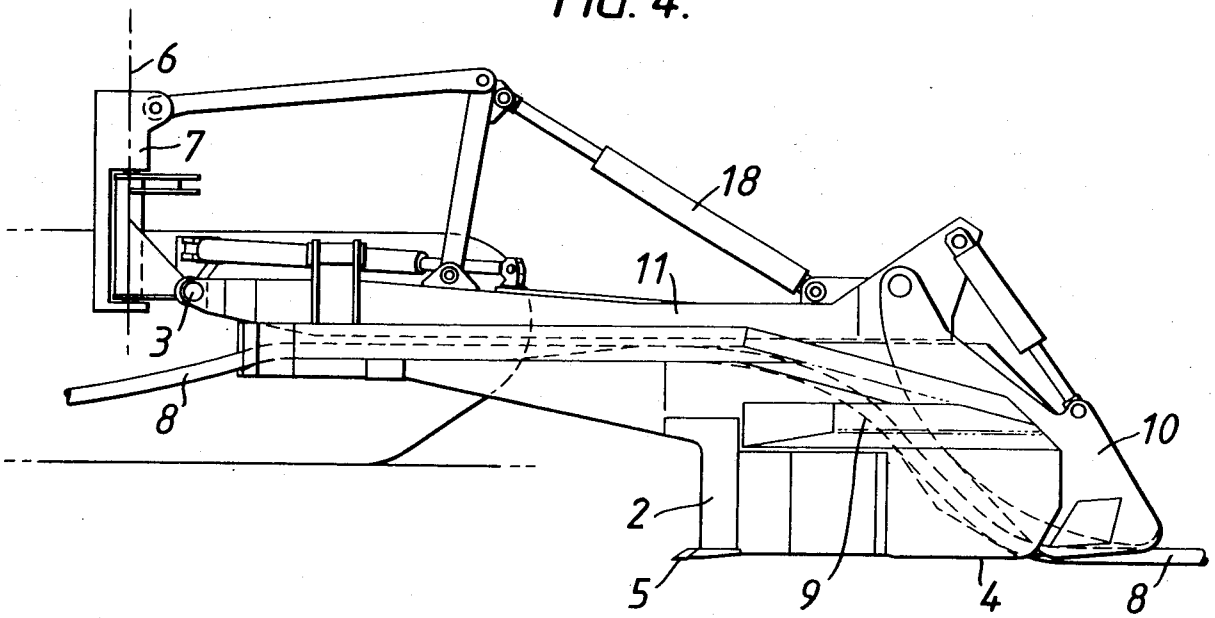
Figure 5:
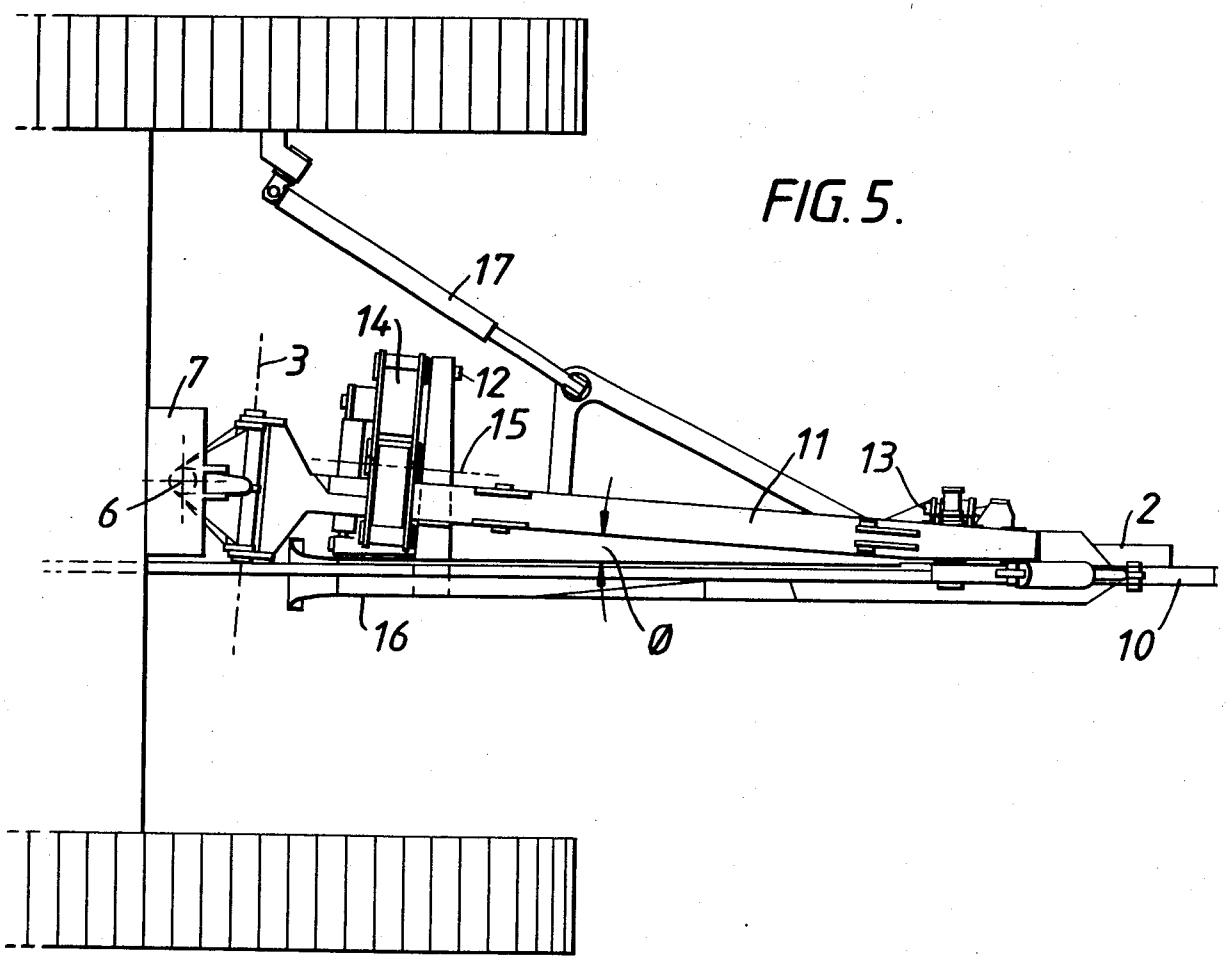
Figure 6:
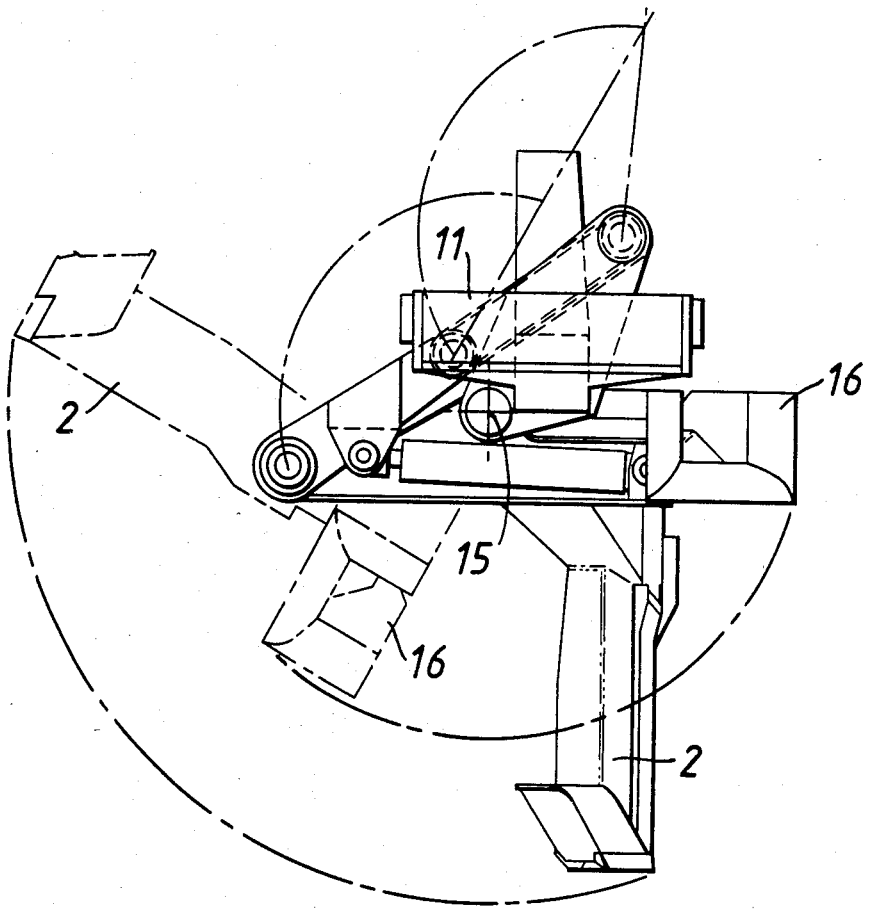
Figure 7:
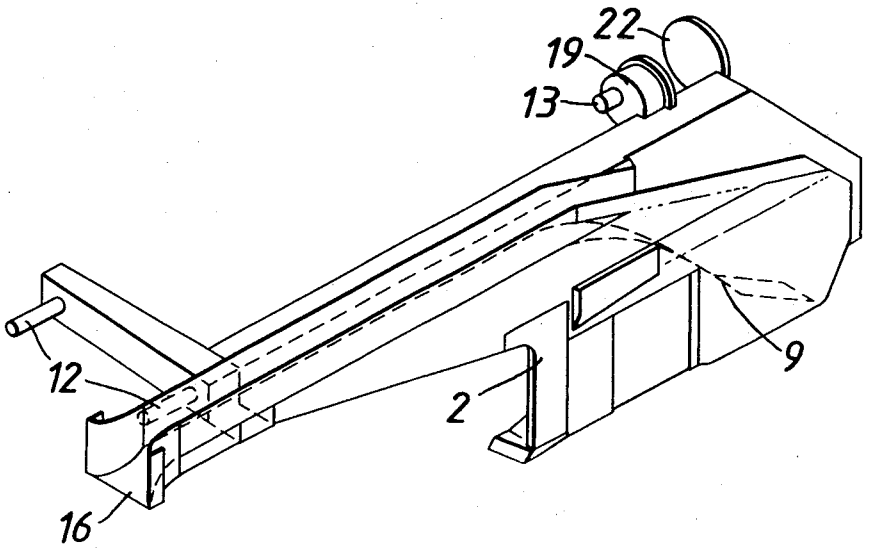
Figure 8:
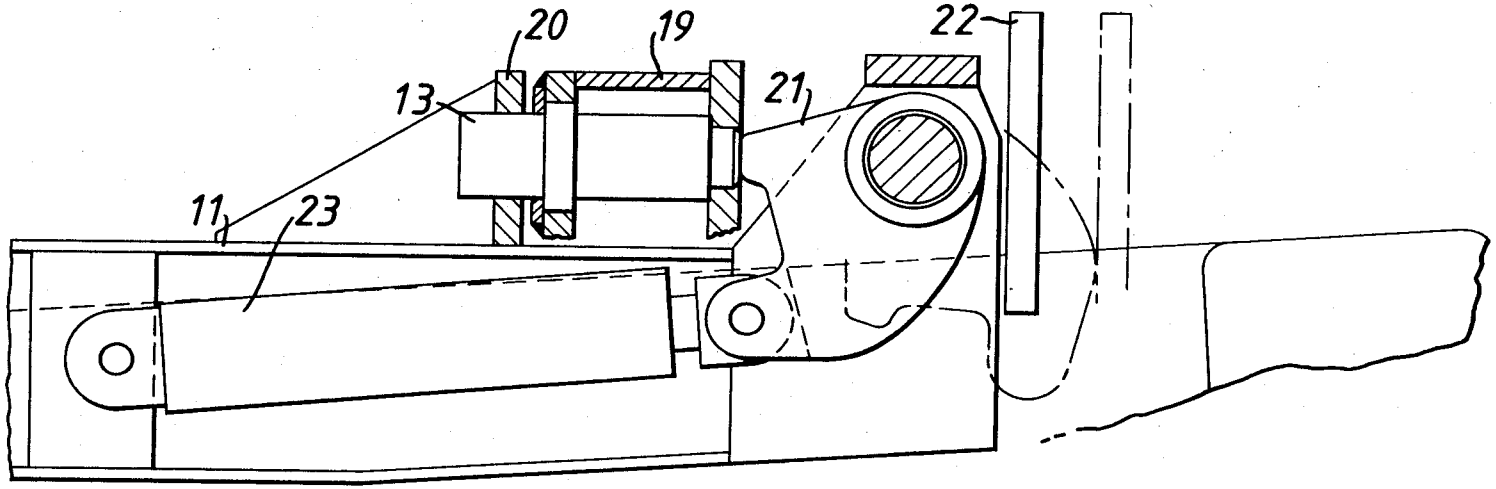

The invention is illustrated with reference to FIGS. 1–8 of the accompanying drawings wherein FIGS. 1 and 2 are schematic diagrams showing in particular a bell-mouth entry system, FIG. 3 is a front elevation of the latter, FIGS. 4 and 5 are elevation and plan views respectively of the jib, plough and carriage assembly, FIG. 6 is an elevation of the plough rotating mechanism, FIG. 7 is an isometric drawing of the plough and FIG. 8 is an enlarged section of the release mechanism.

The system consists of two parts mounted on a conventional sea bed tractor, as shown in FIGS. 1 and 2, a bell-mouth 1, at the front for receiving the cable either directly from the ship or by picking it up from the seabed, and a plough 2 at the rear to insert the cable into the ground.

The main function of the bell-mouth is to enable the cable to bend as it meets the tractor around radii large enough to prevent damage to the cable. This requirement can be met by a bell-mouth of the shape shown in FIG. 1 where the angle $\phi$ is made as large as possible, with 90° as a practical maximum and the angle $\alpha$ is small, of the order of 20°, to provide a nearly flat floor to the bell-mouth. The angle $\phi$ extends round to the horizontal plane as shown in FIG. 2.

So that the cable can be loaded into the bell-mouth while the system is on the seabed, the bell-mouth is provided with one or two doors 1A and 1B which can be opened as shown in FIG. 3. In order to engage the cable, the tractor stands over the cable lying on the seabed and parallel to it, with the bell-mouth doors open. The cable laying ship then tightens up the cable, pulling it up into the bell-mouth, when the doors are closed. Alternatively the cable can be lifted up into the bell-mouth by a crane on the tractor. In order to ensure that the cable is right up in the throat of the bell-mouth before the doors are closed, a cable detecting device is preferably placed at the top rear of the bell-mouth. The cable can very simply be emptied out of the bell-mouth by fully opening its doors. The cable passes from the bell-mouth under the tractor into the plough 2.

This is more fully illustrated in FIGS. 4 and 5. The plough 2 is free to pivot about a horizontal axis 3. The depth of cut is determined by the plough cutting down into the ground until the heel 4 runs on the surface cut by the share 5. In order to facilitate steering of the tractor, the plough is also free to rotate in a horizontal plane about the axis 6 which is placed near the centre of the tractor's tracks or wheels. The two axes 3 and 6 are conveniently placed close together and form a universal joint. In order to control the depth of the plough this joint is mounted on a slider 7 which can be moved up and down, by hydraulic means. The cable 8 to be buried passes along a channel 16 in the beam of the plough, down and around the S-shaped bend 9 and out at the bottom of the trench. It is forced down by the dipper 10 which is usually removeable to facilitate insertion of the cable. In conventional ploughs the dipper 10 is bolted in place after the cable has been inserted into the plough manually. However, in the improved plough assembly according to the present invention this part can be moved in and out of the plough by hydraulic means.

The plough 2 is suspended from a jib 11 by pins 12 and 13. There are two pins 12 (FIGS. 5 and 7) which engage in holes in a cross beam 14 which itself can pivot about the main beam 11 about an axis 15 which contains the pin 13. The cross beam 14 is rotated by a hydraulically powered, over-centre, rollover mechanism relative to jib 11 through an angle greater than 90° and preferably greater than 120°. The rollover mechanism is shown in FIG. 6 and locks into the ploughing position. The plough 2 is set relative to the jib 11 to one side, at an angle $\phi$ as shown on FIG. 5. This causes the plough to run to one side of the tractor centre line and jib so that the channel for the cable is clear of the pivots 3 and 6 and drawbar slider 7. The jib is connected to the rear of the tractor by a hydraulic ram 17 which can rotate the plough about pivot 6 or can lock it against side swing when lifted or allow it to swing sideways freely when ploughing.

The arrangement described has the advantage that it can pick the cable up onto the ground, and can unload it back out of the ground without manual assistance. In order to load the cable the tractor stands over the cable which is lying on the ground with the cable parallel to the tractor tracks and to the left of the tractor centre line. The dipper 10 is lifted up, the plough 2 is slewed to the right with ram 17, rotated about its longitudinal axis through 90° from the ploughing position and lowered with the slider 7 and the lift ram 18 until the plough is lying flat on its side on the ground with the channel 16 on its side facing the cable. The plough is then swung sideways with ram 17 until the cable is laying inside the rear of the channel 16. The plough is then lifted back into the normal position by means of ram 18, slider 7 and the rollover mechanism, and the dipper 10 is lowered to force the cable down into the plough.

To eject the cable from the plough it is raised up out of the ground, the dipper 10 lifted up out of the plough and the plough rotated through at least 90° when the cable falls out of the channel 16.

The locating pin 13 is mounted in a housing 19 on the plough 2 and located in a corresponding aperture in a plate 20 attached to the jib 11. The front face of a cam 21 bears against the housing 19 in its normal position and thereby prevents the pin 13 and hence the plough 2 from disengaging when the jib is moved forward by the carriage. The rear face of the cam bears against a further plate 22 attached to the plough. The position of the cam 21 is controlled by a sonar triggered, accumulator powered hydraulic ram 23 mounted on the jib.

To eject the plough, the ram 23 is actuated and this rotates the cam so that the front face no longer bears against the casing 19 and the rear face pushes the plate 22 backwards thereby retracting the plough and disengaging the pin 13 from its location in the jib plate 20. The movement of the plough also disengages pins 12 from their location in the jib beam 14.

After opening the bell-mouth doors, the bell-mouth, tractor, jib and dipper can then be lifted clear leaving the plough behind to be recovered subsequently.

We claim:

1. A self-loading plough assembly comprising (1) a plough haing a channel for the passage of cable or pipe therethrough and a cutter or cutters for cutting and lifting a wedge of material from a substrate to form a trench into which the cable or pipe is laid;

(2) a jib for supporting the plough and (3) a carrier for supporting the jib; the plough being rotatably mounted under the jib about an axis substantially parallel to the direction of movement of the plough so that the plough can move in an arc of a circle substantially perpendicular to the said substrate the said jib being slidably mounted on the carrier about a substantially vertical axis whereby the jib can be raised or lowered.

2. A self-loading plough assembly according to claim 1 wherein the jib is pivoted for movement about a vertical axis and also a horizontal axis.

3. A self-loading plough assembly according to claim 2 wherein the jib is pivoted for movement about the vertical axis and the horizontal axis by means of a universal joint.

4. A self-loading plough assembly according to claim 1 wherein the plough is set at an angle relative to the jib to enable to plough to run to one side of the jib so that the channel is clear of all mountings and pivots.

5. A self-loading plough assembly according to claim 1 comprising a pivoted curved plate attached to the jib to urge the cable into the channel so that the cable emerges from the base of the channel.

6. A self-loading plough assembly according to claim 1 and a carriage, the plough assembly being mounted on the carriage.

7. A self-loading plough assembly according to claim 6 wherein the carriage is fitted with an entry system for the cable or pipe.

8. A self-loading plough assembly according to claim 7 wherein the entry system comprises a bell-mouth having a flared upper section and an opening lower section comprising two pivoted arms.

9. A self-loading plough assembly according to claim 1 comprising a release mechanism able to disconnect the plough from the rest of the assembly.

10. A self-loading plough assembly according to claim 9 wherein the release mechanism comprises a locating pin attached to the plough, a cam attached to the jib, and a plate attached to the plough, the cam being positioned between the pin and the plate.

* * * * *